US011835051B2

(12) United States Patent
Yang et al.

(10) Patent No.: US 11,835,051 B2
(45) **Date of Patent: *Dec. 5, 2023**

(54) CEILING FAN

(71) Applicant: LG ELECTRONICS INC., Seoul (KR)

(72) Inventors: Seungdeok Yang, Seoul (KR); Jaehyuk Jung, Seoul (KR); Juhyun Kim, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/110,642

(22) Filed: Feb. 16, 2023

(65) Prior Publication Data

US 2023/0265855 A1 Aug. 24, 2023

(30) Foreign Application Priority Data

Feb. 22, 2022 (KR) ..... 10-2022-0023072

(51) Int. Cl.
*F04D 29/38* (2006.01)
*F04D 25/08* (2006.01)

(52) U.S. Cl.
CPC ..... *F04D 25/088* (2013.01); *F04D 29/384* (2013.01)

(58) Field of Classification Search
CPC ..... F04D 25/088; F04D 29/384
See application file for complete search history.

(56) References Cited

U.S. PATENT DOCUMENTS 9,726,192 B2 * 8/2017 Whitley ..... F04D 29/325
10,527,046 B2 * 1/2020 Niemiec ..... F04D 29/384
2013/0272879 A1 * 10/2013 Chen ..... F04D 25/088 416/5

FOREIGN PATENT DOCUMENTS

KR 10-2019-0140865 12/2019

* cited by examiner

*Primary Examiner* — Sabbir Hasan
(74) *Attorney, Agent, or Firm* — KED & ASSOCIATES

(57) ABSTRACT

A ceiling fan includes: a column; a hub case which is coupled to the column and rotatable with respect to the column; and a plurality of blades disposed in the hub case, wherein each of the blades comprises: an upper blade having one end coupled to the hub case; a lower blade which has one end coupled to the hub case and is spaced apart from the upper blade; and an end tip connecting the other end of the upper blade and the other end of the lower blade.

20 Claims, 11 Drawing Sheets

FIG. 6

| | rpm | Power [W] | Efficiency [CFM/W] | Coverage |
|---|---|---|---|---|
| Comparative example | 152 | 20.9 | 277.6 | 8.5 |
| Embodiment | 148 | 20.8 | 281.4 | 8.4 |

CEILING FAN

This application claims priority under 35 U.S.C. § 119 to Korean Patent Application No. 10-2022-0023072, filed Feb. 22, 2022, whose entire disclosures are hereby incorporated by reference.

TECHNICAL FIELD

This disclosure relates to a ceiling fan installed on a ceiling.

BACKGROUND

An apparatus installed on a ceiling to generate air flow is called a ceiling fan.

The ceiling fan consumes less power than an air conditioner or a general electric fan, and since it is installed on the ceiling to flow air toward a floor, it can convect indoor air effectively.

That is, the ceiling fan can forcibly convect air with a relatively large capacity at a ceiling that is located higher than a user.

In general, a ceiling fan includes a driving motor that provides power and a plurality of blades connected to a shaft of the driving motor.

Korean Patent Publication No. 10-2019-0140865 (hereinafter, referred to as prior art) discloses a ceiling fan.

A ceiling fan according to the prior art includes a main blade and a sub blade.

However, since the ceiling fan according to the prior art cuts off a part of the main blade and arranges the sub-blade inside the main blade, there is a problem in that a lift generated through rotation of the sub-blade is inevitably limited.

In particular, the air volume is reduced in a blade portion close to a hub, thereby reducing a total air volume.

SUMMARY

The disclosure has been made in view of the above problems, and may provide a ceiling fan capable of increasing air volume by maximizing a lift.

In addition, the disclosure may further provide a ceiling fan that suppresses vibration of tandem blade maximizing the air volume and maintains a gap between the blades.

In addition, the disclosure may further provide a ceiling fan that reduces vortices and induced drag generated in a distal end of blade.

In accordance with an aspect of the present disclosure, a ceiling fan includes: a column; a hub case which is coupled to the column and rotatable with respect to the column; and a plurality of blades disposed in the hub case, wherein each of the blades includes: an upper blade having one end coupled to the hub case; a lower blade which has one end coupled to the hub case and is spaced apart from the upper blade; and an end tip connecting the other end of the upper blade and the other end of the lower blade.

The upper blade is disposed in a position higher than the lower blade.

The upper blade and the lower blade have an overlapping area in which a partial area overlaps in an axial direction of the hub case.

A width of the overlapping area is smaller than a width of the upper blade and the lower blade.

A width of the overlapping area is larger than a separation distance between the upper blade and the lower blade in the axial direction.

A width of the overlapping area is larger than a thickness of the upper blade and the lower blade.

The end tip extends in a direction orthogonal to a line extending in a radial direction from a rotation axis of the hub case.

The upper blade and the lower blade extend in a radial direction, and the end tip extends in a direction orthogonal to the radial direction.

The end tip includes: a first tip area overlapping a part of the upper blade in a radial direction; and a second tip area overlapping the lower blade in the radial direction.

A width of the first tip area is smaller than a width of the second tip area.

The upper blade and the lower blade have an overlapping area in which a partial area overlaps in an axial direction of the hub case, wherein the second tip area overlaps the overlapping area in the radial direction.

A width of the second tip area is larger than or equal to a sum of a height of the overlapping area, a thickness of the upper blade, and a thickness of the lower blade.

A width of the second tip area gradually increases in a boundary with the first tip area.

A vertical width of the end tip increases in a rearward direction from a front side and then decreases again.

At least a part of the upper blade has a curvature in which a center of radius of curvature is located below the upper blade.

At least a part of the lower blade has a curvature in which a center of radius of curvature is located below the lower blade.

An exit angle of the lower blade is smaller than an entrance angle of the upper blade.

An entrance angle of the lower blade is the same as an exit angle of the upper blade.

The end tip includes: a first plate which defines a surface intersecting a radial direction, and is connected to the upper blade and the lower blade; and a second plate which is connected to the first plate, and defines a surface intersecting the first plate.

The second plate is connected to an upper end of the first plate.

BRIEF DESCRIPTION OF THE DRAWINGS

The above and other objects, features and advantages of the present disclosure will be more apparent from the following detailed description in conjunction with the accompanying drawings, in which:

FIG. 6 is experimental data comparing the efficiencies of a comparative example and an embodiment;

DETAILED DESCRIPTION

Hereinafter, various embodiments of the present disclosure will be described with reference to accompanying drawings. However, the embodiment is not limited to specific embodiments, but the embodiment includes all modifications, equivalents, and/or substitutes belonging to the technical scope of the embodiment without departing from the spirit of the embodiment. Like or the same elements designated by like or the same numerals are used in drawings.

In the specification, expressions such as "A or B," "at least one of A or/and B," or "one or more of A or/and B" may include all possible combination of listed items. It will be understood that when an element (e.g., first element) is referred to as being "connected" or "coupled" to another element (e.g., second element), it can be directly connected or coupled to the other element (e.g., third element) or intervening elements may be present.

Figure 1:
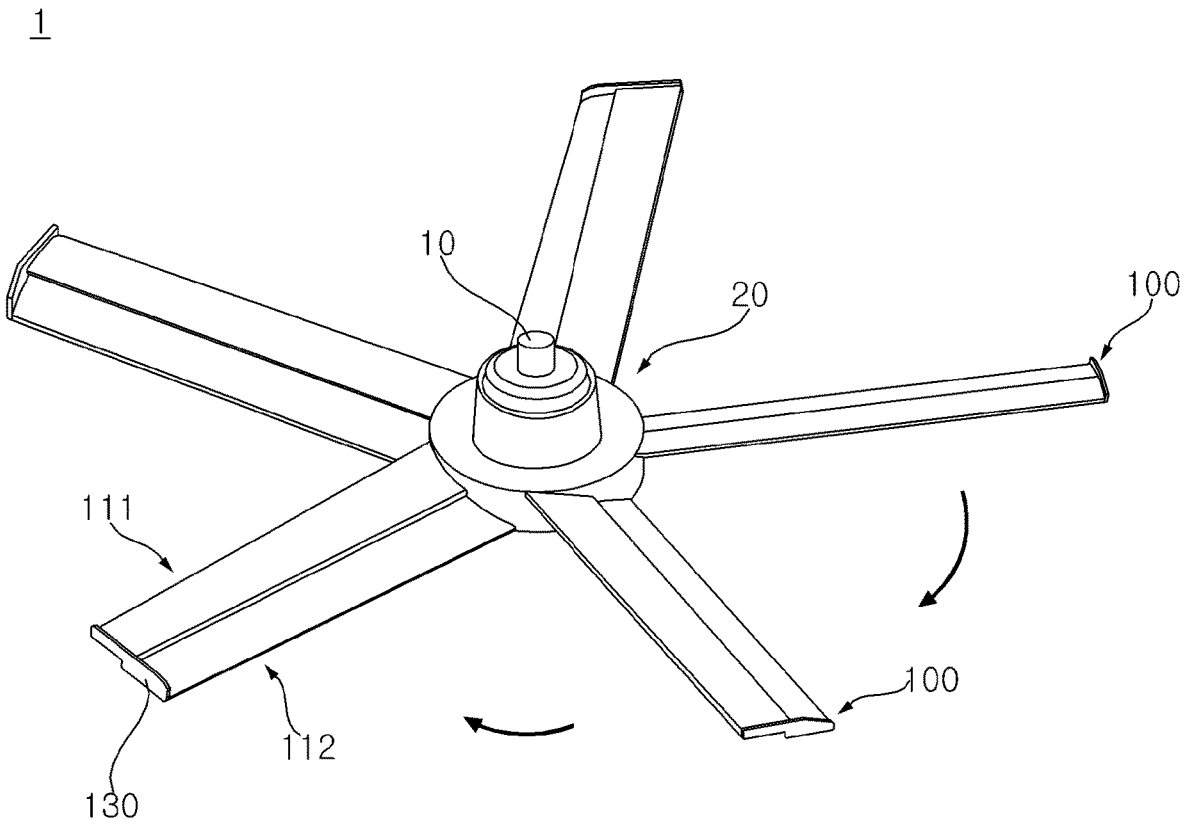
FIG. 1 is a perspective view showing a ceiling fan according to an embodiment of the present disclosure.

FIG. 1 is a perspective view showing a ceiling fan according to an embodiment of the present disclosure.

Referring to FIG. 1, a ceiling fan 1 according to an embodiment of the present disclosure includes a column 10 fixed to the ceiling, a hub case 20 which is disposed in the lower side of the column 10 and rotatable with respect to the column 10, a plurality of blades 100 which are disposed in the hub case 20 and disposed radially around the column 10, and a motor (not shown) which is disposed inside the hub case 20, fixed to the column 10 side, and provides rotational force to the hub case 20.

The column 10 may extend long in the up-down direction. The upper end of the column 10 is fixed to the ceiling, and the lower end of the column 10 is coupled to the hub case 20. The lower end of the column 10 is disposed rotatably relative to the hub case 20.

The hub case 20 can be rotated with respect to the column 10. The hub case 20 is formed in a cylindrical shape, and the blade 100 is coupled to the hub case 20.

The blade 100 is disposed to protrude outward in the radial direction from an outer circumferential surface of the hub case 20.

When viewed in the axial direction of the blade, the blade 100 is disposed radially around the column 10. In the present embodiment, five blades 100 are disposed. Unlike the present embodiment, the number of blades 100 may be changed.

Here, the axial direction of the blade may be parallel to the upward direction based on FIG. 1.

If classification is required, the five blades 100 may be classified into first to fifth blades. Hereinafter, the blade will be described in detail.

Figure 2:
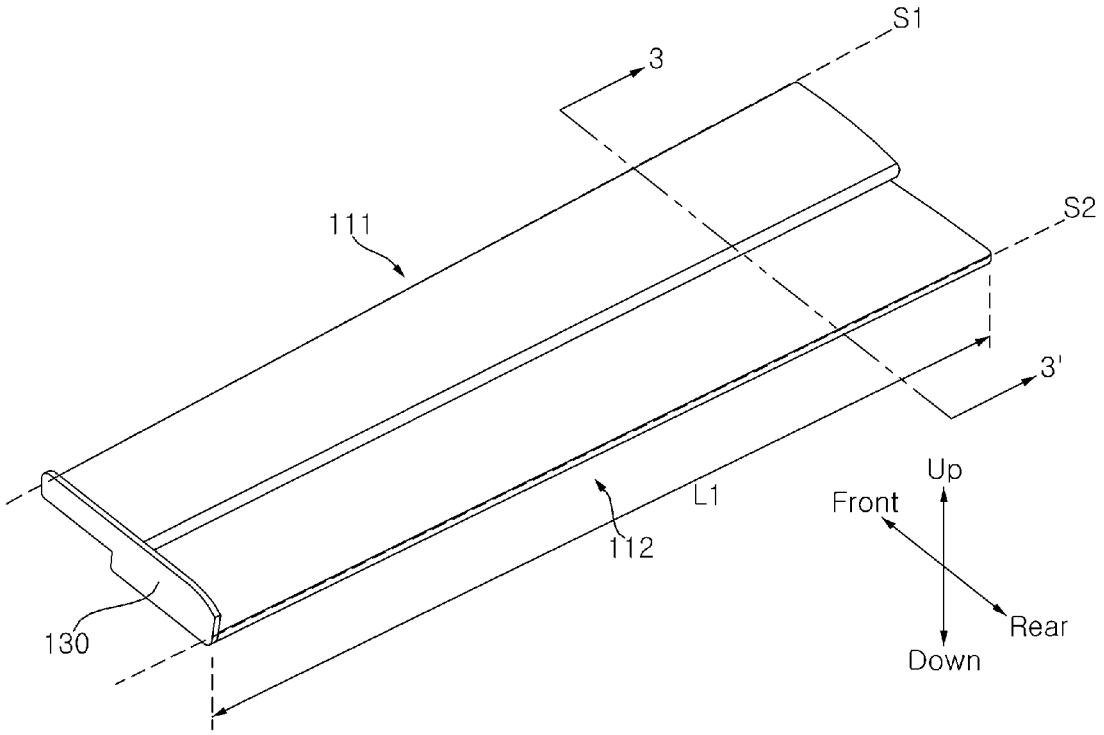
FIG. 2 is a perspective view showing a blade shown in FIG. 1.
Figure 3:
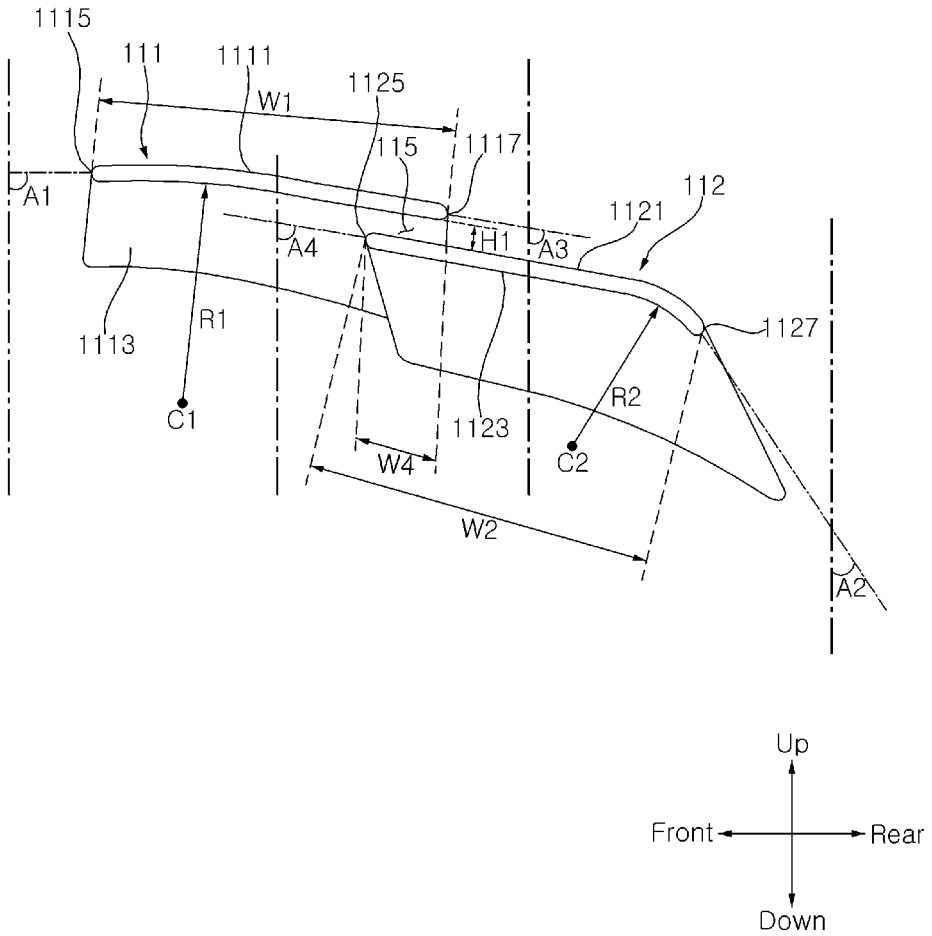
FIG. 3 is a cross-sectional view taken along line 3-3' of the blade shown in FIG. 2.

FIG. 2 is a perspective view showing the blade shown in FIG. 1, and FIG. 3 is a cross-sectional view taken along line 3-3' of the blade shown in FIG. 2.

Referring to FIGS. 1 to 3, the blade 100 includes an upper blade 111 having one side coupled to the hub case 20, a lower blade that has one side coupled to the hub case 20 and is disposed spaced apart from the upper blade 111, and an end tip 130 connecting the other end of the upper blade 111 and the other end of the lower blade 112.

When the blade 100 is composed of a single blade, there is a problem in that a sufficient air volume cannot be obtained because the central portion of the blade has a small moving distance per rotation. Therefore, in order to solve this problem, the present disclosure uses a dual structure of the upper blade 111 and the lower blade 112 for each blade 100.

The upper blade 111 and the lower blade 112 may be spaced apart from each other. The upper blade 111 and the lower blade 112 may be spaced apart from each other in an up-down direction, and partially overlap each other in a left-right direction.

Specifically, the rear end of the upper blade 111 and the front end of the lower blade 112 may be disposed to overlap in the up-down direction, and the upper blade 111 may be disposed in a position higher than the lower blade 112.

Here, a forward direction is a direction shown in FIGS. 2 and 3, and is a direction orthogonal to the up-down direction and the radial direction. The blade 100 rotates in the forward direction.

More specifically, the upper blade 111 may include a first negative pressure surface 1111 defining a surface intersecting the axial direction, a first positive pressure surface 1113 that defines a surface intersecting the axial direction and is located below the first negative pressure surface 1111, a first leading edge 1115 connecting the first negative pressure surface 1111 and the first positive pressure surface 1113, and a first trailing edge 1117 that connects the first negative pressure surface 1111 and the first positive pressure surface 1113 and is disposed rearward than the first leading edge 1115.

The lower blade 112 may include a second negative pressure surface 1121 defining a surface intersecting the axial direction, a second positive pressure surface 1123 that defines a surface intersecting the axial direction and is located below the second negative pressure surface 1121, a second leading edge 1125 connecting the second negative pressure surface 1121 and the second positive pressure surface 1123, and a second trailing edge 1127 that connects the second negative pressure surface 1121 and the second positive pressure surface 1123 and is disposed rearward than the second leading edge 1125.

An area adjacent to the first trailing edge 1117 of the upper blade 111 and an area adjacent to the second leading edge 1125 of the lower blade 112 are disposed to overlap in the up-down direction.

In other words, the upper blade 111 and the lower blade 112 may have an overlapping area 115 in which a partial area overlaps in the axial direction of the hub case 20. The upper blade 111 and the lower blade 112 may be prevented from twisting and the air volume may be increased by forming such an overlapping area 115.

The width W4 of the overlapping area 115 may be smaller than width W2 of the upper blade 111 and the lower blade 112. This is because that if the width W4 of the overlapping area 115 is larger than the width W2 of the upper blade 111 and the lower blade 112, manufacturing cost and weight of the blade increase too much.

Preferably, the width W4 of the overlapping area 115 may be 10% to 20% of the width W2 of the upper blade 111 and the lower blade 112.

The width W4 of the overlapping area 115 may be larger than a separation distance between the upper blade 111 and the lower blade 112 in the axial direction. Preferably, the width W4 of the overlapping area 115 may be 2 to 5 times the separation distance between the upper blade 111 and the lower blade 112 in the axial direction.

The width W4 of the overlapping area 115 may be larger than the thicknesses of the upper blade 111 and the lower blade 112. This is because that if the width W4 of the overlapping area 115 is smaller than the thickness of the upper blade 111 and the lower blade 112, twisting of the blades is not prevented and the increasing effect of air volume is not great.

The height H1 (the separation distance between the upper blade 111 and the lower blade 112 in the axial direction) of the overlapping area 115 may be larger than the thickness of the upper blade 111 and the thickness of the lower blade 112. Preferably, the height H1 of the overlapping area 115 may be 1.5 to 3 times the thickness of the upper blade 111 and the thickness of the lower blade 112.

If the height H1 of the overlapping area 115 is too large, there is a problem that the size of the fan increases because the thickness of the entire blade becomes too thick. In addition, if the height H1 of the overlapping area 115 is smaller than the thickness of the upper blade 111 and the thickness of the lower blade 112, air flowing along the first positive pressure surface 1113 of the upper blade 111 cannot sufficiently escape through the overlapping area 115, thereby cannot providing lift to the lower blade 112.

The overlapping area 115 may extend in a radial direction orthogonal to the axial direction. The overlapping area 115 may be disposed in a center between the first leading edge 1115 of the upper blade 111 and the second trailing edge 1127 of the lower blade 112 when viewed in the axial direction.

The upper blade 111 and the lower blade 112 may have the same length. This is because that, if the lengths of the upper blade 111 and the lower blade 112 are different, the connection point with the end tip 130 is different, which makes it difficult to manufacture and makes it difficult to control the air volume and efficiency.

Vertical cross sections of the upper blade 111 and the lower blade 112 may be formed in an airfoil shape. Alternatively, the upper blade 111 and the lower blade 112 may have an inclination with respect to the axial direction.

Specifically, the upper blade 111 and the lower blade 112 may be disposed inclined downward as it progresses from the front side to the rear side. That is, the first leading edge 1115 may be located in the upper side than the first trailing edge 1117, and the second leading edge 1125 may be located in the upper side than the second trailing edge 1127.

The inclination angle of the upper blade 111 may be larger than or equal to the inclination angle of the lower blade 112. The inclination angle of the upper blade 111 means an angle formed by an arbitrary line connecting the first leading edge 1115 and the first trailing edge 1117 with respect to the axial direction.

The exit angle A2 of the lower blade 112 may be smaller than the entrance angle A1 of the upper blade 111.

The entrance angle A4 of the lower blade 112 may be the same as the exit angle A3 of the upper blade 111. When the entrance angle A4 of the lower blade 112 and the exit angle A3 of the upper blade 111 have the same angle, the lower blade 112 and the upper blade 111 operate like a single blade to reduce air resistance.

The entrance angle A1 of the upper blade 111 may have an acute angle close to 90 degrees. Preferably, the entrance angle A1 of the upper blade 111 may be 80 degrees to 87 degrees.

The exit angle A2 of the lower blade 112 may have an acute angle close to 45 degrees. Preferably, the exit angle A2 of the lower blade 112 may be 20 degrees to 45 degrees.

The entrance angle A4 of the lower blade 112 may have an acute angle close to 90 degrees. Preferably, the entrance angle A4 of the lower blade 112 may be 65 degrees to 80 degrees.

The exit angle A3 of the upper blade 111 may have an acute angle close to 90 degrees. Preferably, the exit angle A3 of the upper blade 111 may be 65 degrees to 80 degrees.

The upper blade 111 may have a curvature. Specifically, the upper blade 111 may have a curvature such that the center C1 of the radius of curvature is located lower than the upper blade 111. Thus, the upper blade 111 may have an upwardly convex shape. The radius of curvature R1 of the upper blade 111 may increase as it progresses from front side to rear side.

The lower blade 112 may have a curvature. Specifically, the lower blade 112 may have a curvature such that the center C2 of the radius of curvature is located lower than the lower blade 112. Therefore, the lower blade 112 may have an upwardly convex shape. The radius of curvature R2 of the lower blade 112 may decrease as it progresses from front side to rear side.

Obviously, the curvature may be formed only in a partial area of the upper blade 111 and a partial area of the lower blade 112.

The first leading edge 1115 of the upper blade 111 may be located on a first reference line A1. The first reference line A1 is a straight line extending substantially in the radial direction. The second trailing edge 1127 of the lower blade 112 may be located on a second reference line A2. The second reference line A2 is a straight line extending substantially in the radial direction.

The first reference line A1 and the second reference line A2 may be parallel. Alternatively, the distance between the first reference line A1 and the second reference line A2 may decrease as it goes farther away from the hub case 20.

The width W1 of the upper blade 111 and the width W2 of the lower blade 112 may be larger than 50% of the distance between the first reference line A1 and the second reference line A2. More preferably, the width W1 of the upper blade 111 and the width W2 of the lower blade 112 may be larger than 50% and less than 60% of the distance between the first reference line A1 and the second reference line A2.

In addition, an arbitrary line connecting the centers of the overlapping area 115 may be located in the center of the first reference line A1 and the second reference line A2. An arbitrary line connecting the centers of the overlapping area 115 may be parallel to the first reference line A1 and the second reference line A2.

As another example, an arbitrary line connecting the centers of the overlapping area 115 may be disposed parallel to the radial direction, and the distance between the first reference line A1 and the second reference line A2 may decrease as it progresses in the radial direction.

Figure 4:
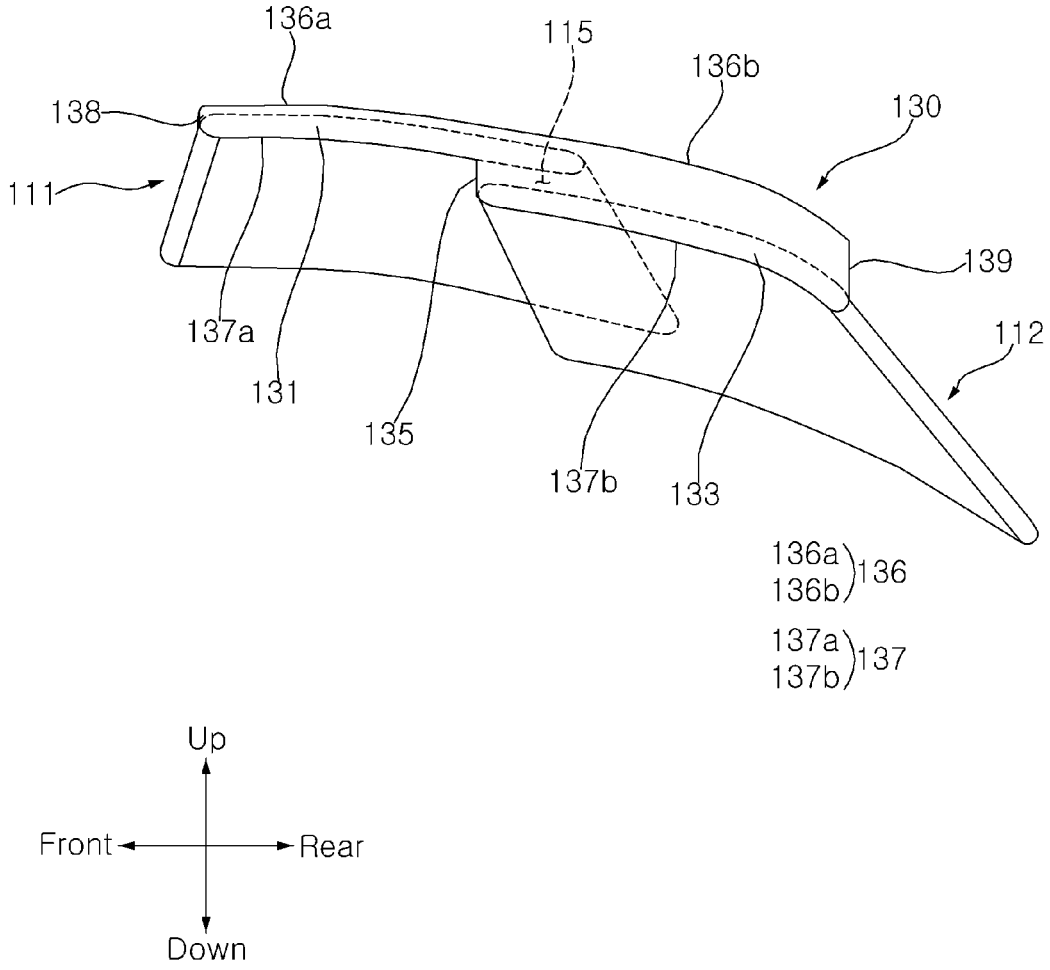
FIG. 4 is a perspective view of the blade shown in FIG. 2 viewed from a radial direction.

FIG. 4 is a perspective view of the blade shown in FIG. 2 viewed from a radial direction. The end tip 130 will be described in detail with reference to FIGS. 2 to 4.

The end tip 130 connects the other end of the upper blade 111 and the other end of the lower blade 112. Accordingly, the end tip 130 connects the other end of the upper blade 111 and the other end of the lower blade 112, thereby reducing vibration generated in the upper blade 111 and the lower blade 112, improving a separation delay that is caused by a change in a gap while the upper blade 111 and the lower blade 112 vibrate at different frequencies, reducing vortex and induced drag generated in a distal end of the upper blade 111 and the lower blade 112, and maintaining a constant distance between the upper blade 111 and the lower blade 112.

The end tip 130 may have various shapes connecting the other end of the upper blade 111 and the other end of the lower blade 112.

For example, the end tip 130 may extend in a direction (front-rear direction) orthogonal to a line extending in a radial direction from the center of the rotation axis of the hub case 20.

When the end tip 130 extends in the front-rear direction, the upper blade 111 and the lower blade 112 rotate, and the moving direction of the end tip 130 coincides with the extension direction of the end tip 130, thereby preventing vibration occurring in the tip 130.

Figure 9:
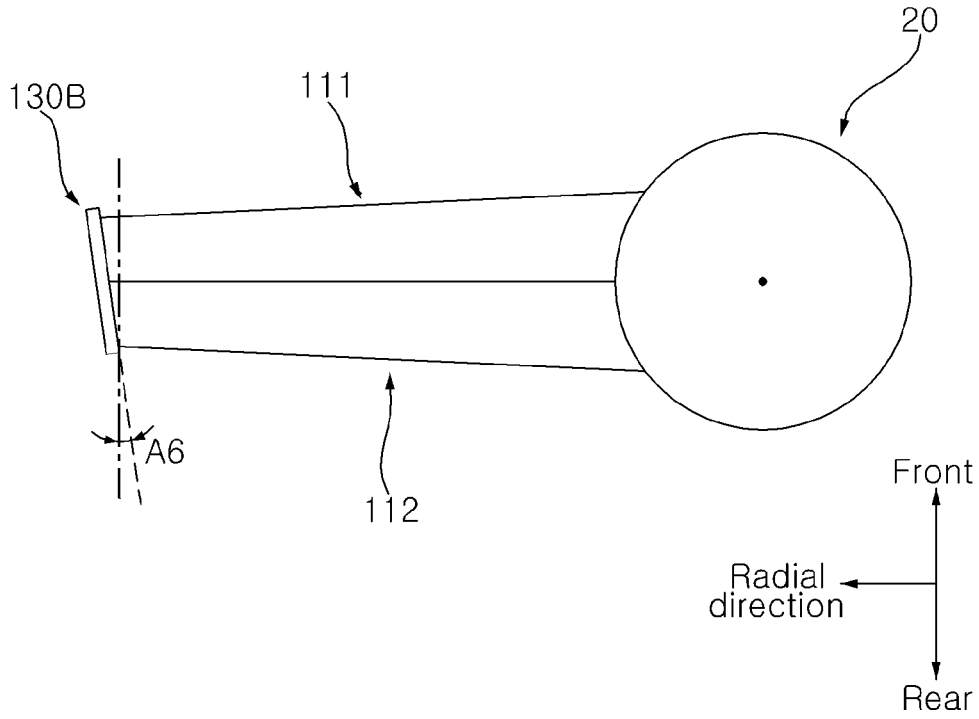
FIG. 9 is a view showing an end tip according to another embodiment of the present disclosure.

Obviously, as another example shown in FIG. 9, the end tip 130 may have an inclination angle A6 with respect to the front-rear direction. Specifically, the front-rear direction and the inclination angle A6 of the end tip 130 may be 3 degrees to 10 degrees. The inclination of the end tip 130 may be formed so that the front end of the end tip 130 is located farther from the center of the hub case 20 than the rear end.

When the front end of the end tip 130 is located farther from the center of the hub case 20 than the rear end, it receives a force in the radial direction as the end tip 130 moves, and applies a force to pull the upper blade 111 and the lower blade 112 in the radial direction, thereby further suppressing vibration of the upper blade 111 and the lower blade 112.

The upper blade 111 and the lower blade 112 may extend in a radial direction, and the end tip 130 may extend in a direction orthogonal to the radial direction.

The end tip 130 may include a first tip area 131 overlapping a part of the upper blade 111 in a radial direction and a second tip area 133 overlapping a part of the lower blade 112 in a radial direction.

The first tip area 131 may be connected to the front and middle ends of the upper blade 111, and the second tip area 133 may be connected to the rear end of the upper blade 111 and the entire lower blade 112. The second tip area 133 may overlap the overlapping area in a radial direction.

The width of the first tip area 131 and the width of the second tip area 133 are not limited. Here, the width of the first tip area 131 and the width of the second tip area 133 mean the length of the first tip area 131 in the vertical direction and the length of the second tip area 133 in the vertical direction.

Preferably, the width of the first tip area 131 may be smaller than the width of the second tip area 133. When the width of the first tip area 131 is larger than or equal to the width of the second tip area 133, the end tip 130 extends to an area where the upper blade 111 is not coupled, so that the self-weight of the end tip 130 increases and the efficiency of the ceiling fan decreases.

In addition, the width of the second tip area 133 may be larger than or equal to the sum of the height H1 of the overlapping area 115, the thickness of the upper blade 111, and the thickness of the lower blade 112.

Preferably, the width of the second tip area 133 may be larger than the sum of the height H1 of the overlapping area 115, the thickness of the upper blade 111, and the thickness of the lower blade 112, so that the upper end of the second tip area 133 may protrude higher than the upper end of the upper blade 111.

When the second tip area 133 protrudes above the upper end of the upper blade 111, the rotation of the upper blade 111 and the lower blade 112 may be guided by the second tip area 133.

Obviously, the upper end of the first tip area 131 may protrude above the upper end of the upper blade 111. When the first tip area 131 protrudes above the upper end of the upper blade 111, the rotation of the upper blade 111 and the lower blade 112 may be guided by the first tip area 131.

The width of the second tip area 133 may gradually increase in a boundary 135 with the first tip area 131. The width of the second tip area 133 may linearly or non-linearly increase at the boundary 135 with the first tip area 131.

The vertical width of the end tip 130 may increase in the rearward direction from the front side and then decrease again.

The end tip 130 may have a plate shape. The end tip 130 may have a shape in which the length in the radial direction is smaller than the length in the vertical direction and the length in the front-rear direction, and the length in the vertical direction is smaller than the length in the front-rear direction.

The end tip 130 may include a tip upper end portion 136, a tip lower end portion 137 that faces the tip upper end portion 136 and is spaced downward from the tip upper end portion 136, a tip front end portion 138 connected to the tip upper end portion 136 and the tip lower end portion 137, and a tip rear end portion 139 that is connected to the tip upper end portion 136 and the tip lower end portion 137 and located rearward than the tip front end portion 138.

The tip upper end portion 136 may include a first tip upper end portion 136*a* forming an upper surface of the first area and a second tip upper end portion 136*b* forming an upper surface of the second area. The tip lower end portion 137 may include a first tip lower end portion 137*a* forming a lower surface of the first area and a second tip lower end portion 137*b* forming a lower surface of the second area.

The first tip upper end portion 136*a* and the first tip lower end portion 137*a* may have a radius of curvature corresponding to the upper blade 111. That is, the first tip upper end portion 136*a* and the first tip lower end portion 137*a* may have curvatures. Specifically, the center (not shown) of the radius of curvature of the first tip upper end portion 136*a* and the first tip lower end portion 137*a* may have a curvature located lower than the first tip upper end portion 136*a* and the first tip lower end portion 137*a*. Accordingly, the first tip upper end portion 136*a* and the first tip lower end portion 137*a* may have an upwardly convex shape. The radius of curvature of the first tip upper end portion 136*a* and the first tip lower end portion 137*a* may increase from front side to rear side.

The second tip upper end portion 136*b* and the second tip lower end portion 137*b* may have a radius of curvature corresponding to the lower blade 112. That is, the second tip upper end portion 136*b* and the second tip lower end portion 137*b* may have a curvature. Specifically, the center (not shown) of the radius of curvature of the second tip upper end portion 136*b* and the second tip lower end portion 137*b* may have a curvature located lower than the second tip upper end portion 136*b* and the second tip lower end portion 137*b*. Accordingly, the second tip upper end portion 136*b* and the second tip lower end portion 137*b* may have an upwardly convex shape. The radius of curvature of the second tip upper end portion 136*b* and the second tip lower end portion 137*b* may decrease from front side to rear side. Obviously, curvature may be formed only in a partial area of the tip upper end portion 136 and the tip lower end portion 137.

The end tip 130 may have an inclination with respect to the axial direction. The end tip 130 may be disposed inclined downward as it progresses from the front side to the rear side. That is, the tip front end portion 138 may be located above the tip rear end portion 139. The inclination of the end tip 130 in the axial direction may be defined as an angle formed by a connection line of the center of the tip front end portion 138 and the center of the tip rear end portion 139 with respect to the vertical direction.

The end tip 130 may be formed in an airfoil shape in a rearward direction from a front side. This will be described in detail in FIGS. 10 and 11.

Figure 5:
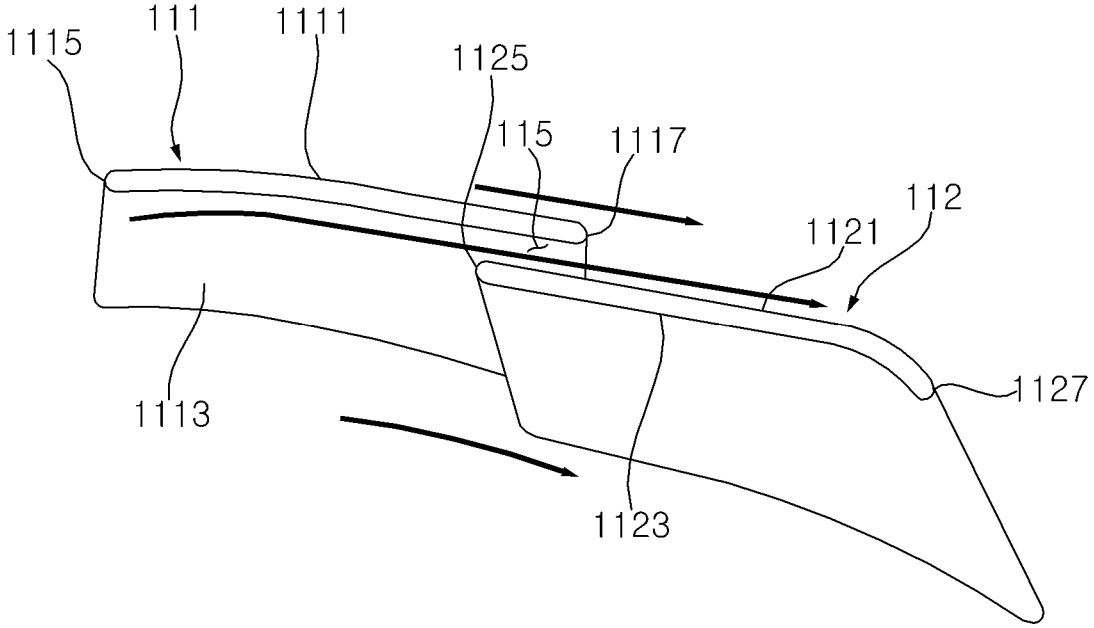
FIG. 5 is an exemplary diagram illustrating air flow in FIG. 3.

Referring to FIG. 5, the air flow during rotation of the ceiling fan will be described.

When the hub case 20 rotates, a plurality of blades 100 also rotate together. At this time, the air pressurized by the upper blade 111 based on a single blade 100 may flow to the lower blade 112.

Specifically, the air pressurized in the first positive pressure surface 1113 of the upper blade 111 may flow to the second negative pressure surface 1121 of the lower blade 112 through the overlapping area 115, may flow downward along the second negative pressure surface 1121 of the lower blade 112, and then may be separated from the second trailing edge 1127 of the lower blade 112 and discharged downward.

In addition, the air pressurized by the second positive pressure surface 1123 of the lower blade 112 may be separated from the second trailing edge 1127 of the lower blade 112 and discharged downward.

As described above, the blade 100 according to the present embodiment constitutes a partial tandem blade, thereby forming a greater lift than a blade having one positive pressure surface and one negative pressure surface, and effectively preventing the twist of an area far from the hub case 20.

FIG. 6 is a diagram showing the efficiency of the fan versus the length of the tandem blade.

Referring to FIG. 6, a comparative example is a ceiling fan having a single blade.

In the case of embodiment, higher efficiency is exhibited at a lower rotational speed than the comparative example.

Figure 7:
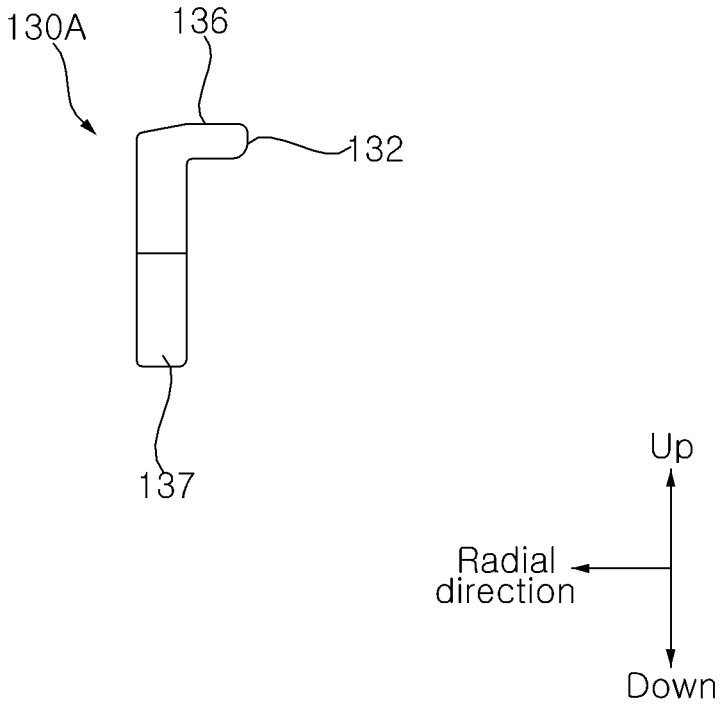
FIG. 7 is a view showing an end tip according to another embodiment of the present disclosure.
Figure 8:
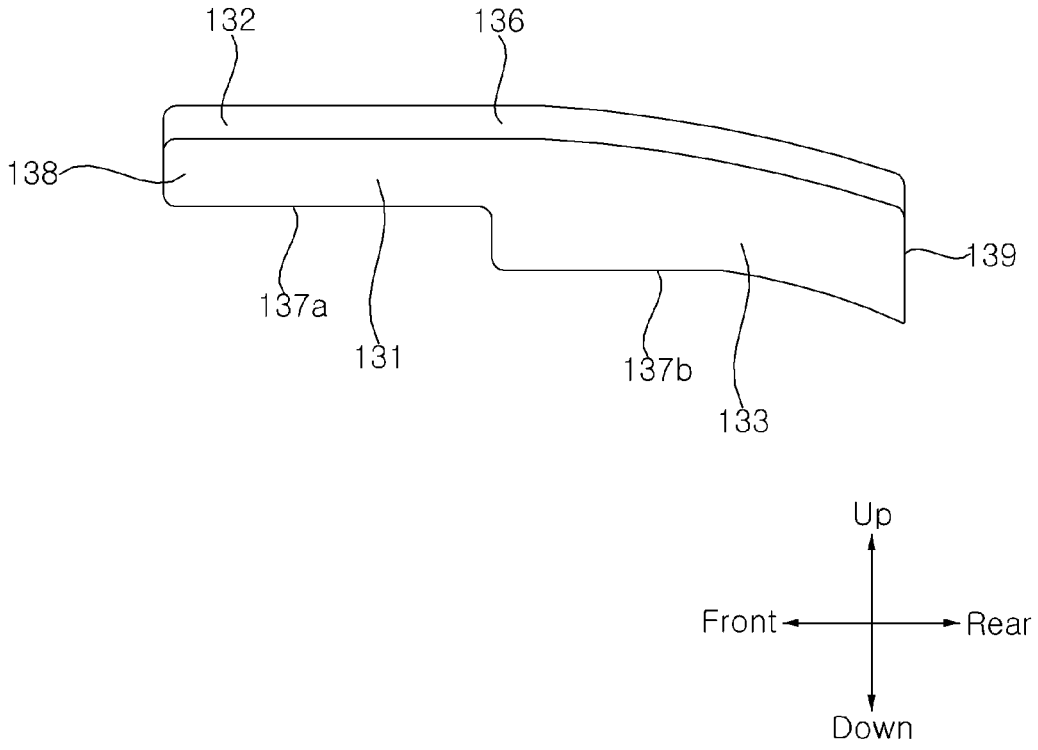
FIG. 8 is a view of the end tip of FIG. 7 viewed from a different direction from FIG. 7.

FIG. 7 is a view showing the end tip 130 according to another embodiment of the present disclosure, and FIG. 8 is a view of the end tip 130A of FIG. 7 viewed from a different direction of FIG. 7.

FIGS. 7 and 8 have a difference in the shape of the end tip 130A compared to the embodiment of FIG. 2. Hereinafter, a difference from the embodiment of FIG. 2 will be mainly described.

The end tip 130 according to the embodiment of FIG. 7 may take a form in which two plates are connected. That is, the end tip 130 may include a first plate 131, 133 that defines a surface intersecting the radial direction and is connected to the upper blade 111 and the lower blade 112, and a second plate 132 that is connected to the first plate 131, 133 and defines a surface intersecting the first plate 131, 133.

The second plate 132 may be connected to the upper end of the first plate 131, 133, and the horizontal length of the second plate 132 may be smaller than the vertical length of the first plate 131, 133.

The second plate 132 may reinforce the rigidity of the first plate 131, 133, so that vibration of the upper blade 111 and the lower blade 112 can be further suppressed.

FIG. 9 is a view showing an end tip 130B according to another embodiment of the present disclosure.

FIG. 9 has a difference in the disposition of the end tips 130B compared to the embodiment of FIG. 2. Hereinafter, a difference from the embodiment of FIG. 2 will be mainly described.

The end tip 130 may have an inclination angle A6 with respect to the front-rear direction. Specifically, the front-rear direction and the inclination angle A6 of the end tip 130 may be 3 degrees to 10 degrees. The inclination of the end tip 130 may be formed so that the front end of the end tip 130 is located farther from the center of the hub case 20 than the rear end.

When the front end of the end tip 130 is located farther from the center of the hub case 20 than the rear end, it receives force in the radial direction while the end tip 130 moves, and applies a force to pull the upper blade 111 and the lower blade 112 in the radial direction, thereby further suppressing the vibration of the upper blade 111 and the lower blade 112.

Figure 10:
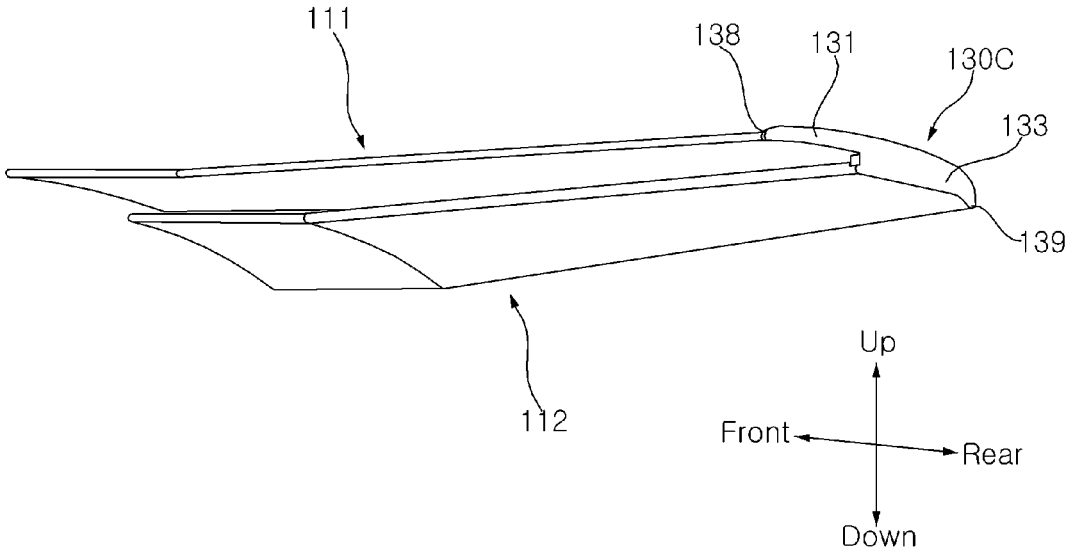
FIG. 10 is a view showing an end tip according to another embodiment of the present disclosure.

FIG. 10 is a diagram illustrating an end tip 130C according to another embodiment of the present disclosure.

FIG. 10 has a difference in the shape of the end tip 130C compared to the embodiment of FIG. 2. Hereinafter, a difference from the embodiment of FIG. 2 will be mainly described.

The end tip 130C of the embodiment of FIG. 10 may be formed in an airfoil shape in a rearward direction from the front side. That is, the vertical width of the front end 138 of the first tip area 131 may gradually increase, and the vertical width of the rear end 139 of the second tip area 133 may gradually decrease.

Figure 11:
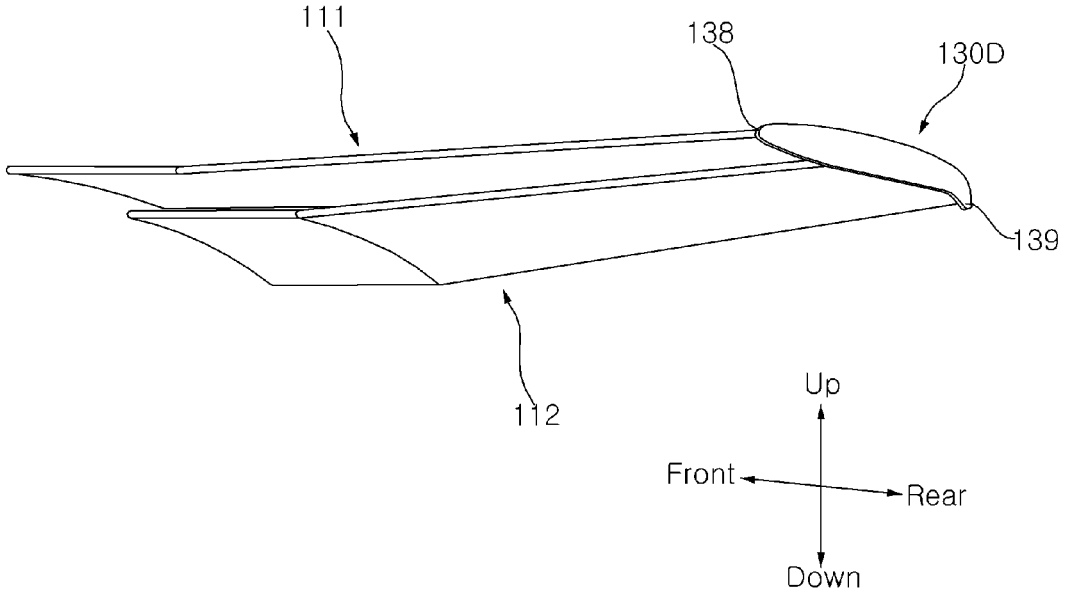
FIG. 11 is a view showing an end tip according to another embodiment of the present disclosure.

FIG. 11 is a diagram showing an end tip 130D according to another embodiment of the present disclosure.

FIG. 11 has a difference in the shape of the end tip 130D compared to the embodiment of FIG. 2. Hereinafter, a difference from the embodiment of FIG. 2 will be mainly described.

The end tip 130D of the embodiment of FIG. 10 may be formed in an airfoil shape in a rearward direction from the front side. That is, the vertical width of the front end 138 of the end tip 130 may gradually increase, and the vertical width of the rear end 139 of the end tip 130 may gradually decrease.

In comparison with the embodiment of FIG. 2, in the embodiment of FIG. 10, the thicknesses of the first tip area 131 and the second tip area 133 do not differ stepwise and are connected in a streamlined shape.

The vertical width of the end tip 130 increases in the front-rear direction, and gradually decreases at the rear end of the end tip 130.

When the end tip 130 is formed in an airfoil shape, air resistance generated by the end tip 130 can be reduced and efficiency of the ceiling fan can be improved.

The present disclosure has the following effects.

First, since the blade according to the embodiment of the present disclosure constitutes a tandem blade, it can form a greater lift than a blade having one positive pressure surface and one negative pressure surface, and through this, can increase the air volume with the same output.

Second, the present disclosure includes an end tip connecting the outer ends of the two blades, thereby reducing vibration generated in two blades, and improving the separation delay caused by the change in the gap while the two blades vibrate at different frequencies.

Third, the present disclosure includes an end tip connecting the outer ends of two blades, thereby reducing vortices and induced drag generated at a distal end of each blade, and maintaining a constant distance between two blades.

Fourth, the present disclosure has an overlapping area where two blades overlap each other, thereby maximizing the air volume and further suppressing twisting of two blades.

While the present disclosure has been particularly shown and described with reference to exemplary embodiments thereof, it will be understood by those of ordinary skill in the art that various changes in form and detail may be made herein without departing from the spirit and scope of the present disclosure as defined by the following claims and such modifications and variations should not be understood individually from the technical idea or aspect of the present disclosure.

What is claimed is:

1. A ceiling fan comprising:

a column;

a hub case which is coupled to the column and rotatable with respect to the column; and a plurality of blades disposed in the hub case, wherein each of the blades comprises:

an upper blade having one end coupled to the hub case;

a lower blade which has one end coupled to the hub case and is spaced apart from the upper blade; and an end tip connecting the other end of the upper blade and the other end of the lower blade.

2. The ceiling fan of claim 1, wherein the upper blade is disposed in a position higher than the lower blade.

3. The ceiling fan of claim 1, wherein the upper blade and the lower blade have an overlapping area in which a partial area overlaps in an axial direction of the hub case.

4. The ceiling fan of claim 3, wherein a width of the overlapping area is smaller than a width of the upper blade and the lower blade.

5. The ceiling fan of claim 3, wherein a width of the overlapping area is larger than a separation distance between the upper blade and the lower blade in the axial direction.

6. The ceiling fan of claim 3, wherein a width of the overlapping area is larger than a thickness of the upper blade and the lower blade.

7. The ceiling fan of claim 1, wherein the end tip extends in a direction orthogonal to a line extending in a radial direction from a rotation axis of the hub case.

8. The ceiling fan of claim 1, wherein the upper blade and the lower blade extend in a radial direction, and the end tip extends in a direction orthogonal to the radial direction.

9. The ceiling fan of claim 1, wherein the end tip comprises:

a first tip area overlapping a part of the upper blade in a radial direction; and a second tip area overlapping the lower blade in the radial direction.

10. The ceiling fan of claim 9, wherein a width of the first tip area is smaller than a width of the second tip area.

11. The ceiling fan of claim 9, wherein the upper blade and the lower blade have an overlapping area in which a partial area overlaps in an axial direction of the hub case, wherein the second tip area overlaps the overlapping area in the radial direction.

12. The ceiling fan of claim 11, wherein a width of the second tip area is larger than or equal to a sum of a height of the overlapping area, a thickness of the upper blade, and a thickness of the lower blade.

13. The ceiling fan of claim 10, wherein a width of the second tip area gradually increases in a boundary with the first tip area.

14. The ceiling fan of claim 1, wherein a vertical width of the end tip increases in a rearward direction from a front side and then decreases again.

15. The ceiling fan of claim 1, wherein at least a part of the upper blade has a curvature in which a center of radius of curvature is located below the upper blade.

16. The ceiling fan of claim 1, wherein at least a part of the lower blade has a curvature in which a center of radius of curvature is located below the lower blade.

17. The ceiling fan of claim 1, wherein an exit angle of the lower blade is smaller than an entrance angle of the upper blade.

18. The ceiling fan of claim 1, wherein an entrance angle of the lower blade is the same as an exit angle of the upper blade.

19. The ceiling fan of claim 1, wherein the end tip comprises:

a first plate which defines a surface intersecting a radial direction, and is connected to the upper blade and the lower blade; and a second plate which is connected to the first plate, and defines a surface intersecting the first plate.

20. The ceiling fan of claim 19, wherein the second plate is connected to an upper end of the first plate.

* * * * *